US006619396B1

(12) United States Patent
Kimoto et al.

(10) Patent No.: US 6,619,396 B1
(45) Date of Patent: Sep. 16, 2003

(54) METHOD OF PRODUCING PETROLEUM

(75) Inventors: Makio Kimoto, Abu Dhabi (JP); Takashi Hiraoka, Yokohama (JP)

(73) Assignee: Japan Oil Development Co., Ltd., Tokyo (JP)

( * ) Notice: Subject to any disclaimer, the term of this patent is extended or adjusted under 35 U.S.C. 154(b) by 0 days.

(21) Appl. No.: 09/979,552

(22) PCT Filed: Feb. 23, 2000

(86) PCT No.: PCT/JP00/01025

§ 371 (c)(1),
(2), (4) Date: Jan. 30, 2002

(87) PCT Pub. No.: WO01/63092

PCT Pub. Date: Aug. 30, 2001

(51) Int. Cl.[7] ..... E21B 43/16
(52) U.S. Cl. ..... 166/268; 166/272.7
(58) Field of Search ..... 166/268, 272.7, 166/401, 250.02

(56) References Cited

U.S. PATENT DOCUMENTS 6,321,840 B1 * 11/2001 Billiter et al. ..... 166/268

OTHER PUBLICATIONS

L. Dello, et al.; "Improved Oil Recovery By Pattern Gas Injection Using Horizontal Wells in a Tight Carbonate Reservoir"; Copyright 1996, Society of Petroleum Engineers; pps. 791–801.

* cited by examiner

*Primary Examiner*—William Neuder
(74) *Attorney, Agent, or Firm*—Antonelli, Terry, Stout & Kraus, LLP

(57) ABSTRACT

The present invention relates to an oil production method for producing oil from an oil-containing reservoir with using horizontal wells, by drilling a gas injection well and a production well to be locate at an appropriate distance between them, depending upon at least a ratio between an averaged vertical permeability and an averaged horizontal permeability in the oil-containing reservoir producing the oil therefrom.

14 Claims, 9 Drawing Sheets

PLANE

CROSS-SECTION

PRESSURE PROFILE

SEMI-CYLINDRICAL FLOW REGION
LINEAR FLOW REGION

FIG. 4

| LAY NO. (FROM TOP TO BOTTOM) | LAYER THICKNESS ft | POROSITY (%) | HORIZONTAL PERMEABILITY mD |
|---|---|---|---|
| 1 | 5.462 | 18.8 | 5.45 |
| 2 | 4.95 | 19.0 | 3.95 |
| 3 | 4.553 | 22.1 | 7.65 |
| 4 | 11.423 | 20.4 | 8.83 |
| 5 | 3.853 | 12.2 | 0.62 |
| 6 | 6.146 | 20.6 | 3.59 |
| 7 | 6.517 | 23.7 | 6.35 |
| 8 | 6.398 | 22.3 | 8.3 |
| 9 | 2.473 | 17.2 | 1.05 |
| 10 | 5.473 | 22.0 | 3.49 |
| 11 | 5.152 | 22.5 | 6.64 |
| 12 | 4.945 | 23.1 | 3.64 |
| 13 | 2.997 | 19.0 | 2.5 |
| 14 | 7.947 | 21.8 | 5.77 |
| 15 | 8.455 | 22.5 | 6.57 |
| 16 | 12.948 | 21.9 | 3.49 |
| 17 | 2.56 | 18.0 | 2.61 |
| 18 | 6.309 | 21.8 | 3.39 |
| 19 | 3.123 | 17.1 | 4.91 |
| 20 | 3.595 | 16.8 | 1.4 |
| 21 | 2.959 | 11.5 | 0.0002 |
| 22 | 6.847 | 12.1 | 0.32 |

CONVERSION INTO SI UNIT ft×3.408 E−01=m mD×9.869233 E−16=$m^2$

| NAME OF INGREDIENT | CRUDE OIL | INJECTION GAS | PURE METHANE |
|---|---|---|---|
| $H_2S$ | 0.000 | 0.000 | 0.000 |
| $CO_2$ | 0.010 | 0.029 | 0.000 |
| N2 | 0.001 | 0.004 | 0.000 |
| C1 | 0.100 | 0.737 | 1.000 |
| C2 | 0.053 | 0.155 | 0.000 |
| C3 | 0.072 | 0.063 | 0.000 |
| C4 | 0.059 | 0.011 | 0.000 |
| C5 | 0.050 | 0.001 | 0.000 |
| $C6^+$ | 0.655 | 0.000 | 0.000 |

METHOD OF PRODUCING PETROLEUM

TECHNICAL FIELD

The present invention relates to an oil production method for producing oil at high recovery factor from oil-containing reservoirs by providing horizontal wells comprising at least a gas injection well and a production well, which are disposed horizontally opposing to each other.

BACKGROUND ART

It is described that improvement can be obtained in productivity of oil through the horizontal well rather than the vertical one, among various oil producing methods, for example, in "7$^{th}$ Abu Dhabi International Petroleum Exhibition & Conference (ADIPEC) Oct. 13–16, 1996, Abu Dhabi-U.A.E., "Proceedings" pp. 791–801, SPEC#36247, "Improved Oil Recovery By Pattern Gas Injection Using Horizontal Wells in a Tight Carbonated Reservoir".

DISCLOSURE OF THE INVENTION

However, in the conventional art mentioned above, any consideration was not paid to optimization of the distance, etc., between the gas injection well and the production well in the horizontal wells to be drilled or excavated.

An object, according to the present invention, is to provide an oil production method, wherein oil can be produced from oil-containing reservoirs at a high recovery factor, by optimizing the distance between the gas injection well and the production well in the horizontal wells to be drilled with respect to a certain oil-containing reservoir.

For accomplishing the above-mentioned object, according to the present invention, there is provided a method for producing oil from an oil-containing reservoir using horizontal wells, which are drilled into the oil-containing reservoir, at an appropriate distance between a gas injection well and a production well thereof, depending upon at least a ratio between an averaged vertical permeability and an averaged horizontal permeability (a ratio kv/kh) in the oil-containing reservoir producing the oil therefrom.

Also, according to the present invention, there is provided a method for producing oil from an oil-containing reservoir using horizontal wells, which are drilled into the oil-containing reservoir with an appropriate distance between a gas injection well and a production well thereof, the distance depending upon at least a ratio between an averaged vertical permeability and an averaged horizontal permeability (a ratio kv/kh), layer thickness and inclination of the oil-containing reservoir producing the oil therefrom.

Also, according to the present invention, there is provided a method for producing oil from an oil-containing reservoir using horizontal wells, which are drilled into the oil-containing reservoir with appropriate distance between a gas injection well and a production well thereof, the distance depending upon at least a ratio between an averaged vertical permeability and an averaged horizontal permeability, layer thickness and inclination of the oil-containing reservoir producing the oil therefrom, and compositions of a gas to be injected as well.

Also, according to the present invention, in the method for producing oil as defined above, the ratio between an averaged vertical permeability and an averaged horizontal permeability (a ratio kv/kh) is calculated up on a basis of a result of a core analysis or a spot test (including a special well test) in the oil-containing reservoir.

Also, according to the present invention, there is provided a method for producing oil from an oil-containing reservoir, comprising a sequence of the following steps:

a first calculation step for calculating a ratio between an averaged vertical permeability and an averaged horizontal permeability, a layer thickness and an inclination, upon a basis of a result of a core analysis or spot test on the oil-containing reservoir producing the oil therefrom;

a second calculation step for calculating an appropriate distance between a gas injection well and a production well, through conducting simulation upon a relationship between viscous force and buoyancy using a model of horizontal wells on said oil-containing reservoir, from the averaged vertical permeability and the averaged horizontal permeability, the layer thickness and the inclination, which are assumed in said first calculation step;

a step for drilling the horizontal wells including the gas injection well and the production well, so that they are kept at the calculated appropriate distance between them, which is calculated out in said second calculation step; and a step for producing the oil from the oil-containing reservoir using the horizontal wells drilled in said drilling step.

BRIEF DESCRIPTION OF THE DRAWINGS

FIG. 4 is a table for showing physical property values in a certain oil-containing reservoir;

BEST MODE FOR CARRYING OUT THE INVENTION

Hereinafter, embodiments of the oil production method according to the present invention will be fully explained by referring to the attached drawings.

Figure 1:
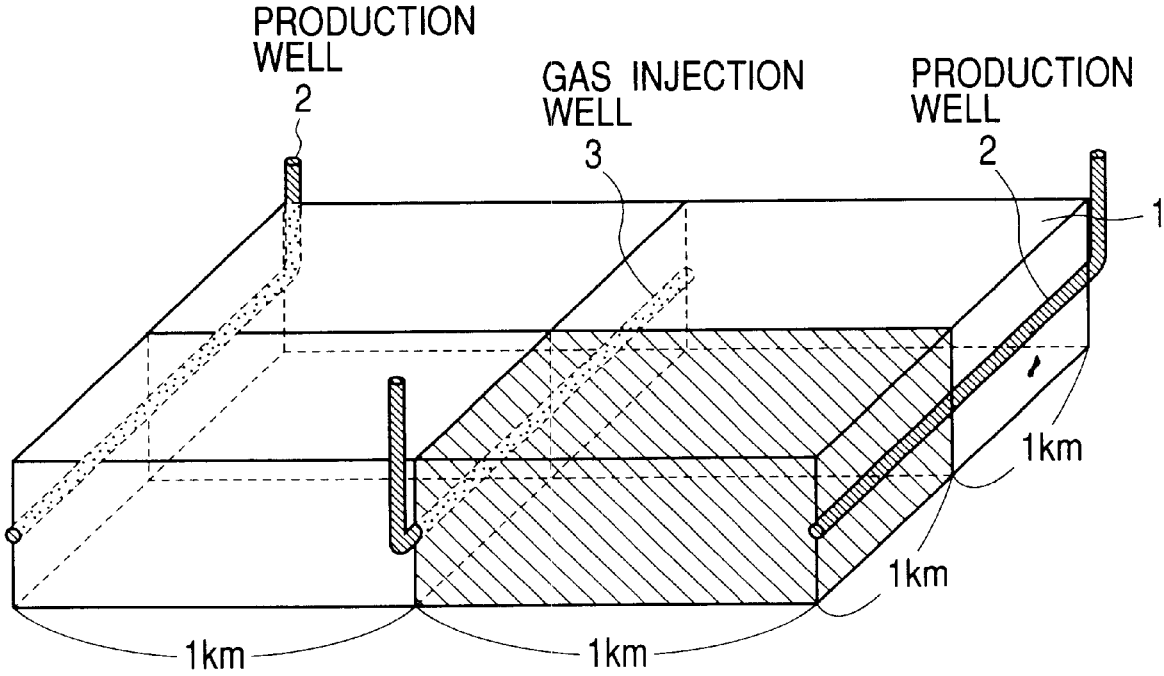
FIG. 1 is a diagrammatic view for showing horizontal wells drilled through an oil formation, according to the present invention.

First, explanation will be given on disposition of horizontal wells, being superior in productivity of oil, according to the present invention, which are drilled into oil-containing reservoirs, by referring to FIG. 1. Namely, for producing crude oil from an oil-containing reservoir 1 pregnant therewith, a horizontal production well 2 is drilled into the oil-containing reservoir. In parallel to the horizontal well 2, horizontal gas injection wells 2 are also drilled into the oil-containing reservoir 1. FIG. 1 shows diagrammatically the condition where the horizontal production well 2 and the horizontal gas injection wells 3, each being about 2 km in length, are drilled with a distance of about 1 km between them.

According to the present invention, in such horizontal wells, a balance is obtained between two (2) kinds of forces, i.e., (1) fluid viscous forces caused by the gas injection wells and the production wells, and (2) buoyancy caused by the difference in density between the crude oil and the injection gas, so that sweep efficiency of the crude oil by the gas injected from the gas injection well 2 with pressure comes to be at a maximum, thereby bringing the recovery factor of crude oil to be a maximum value. For that purpose, the following optimizing method is worked out upon an assumption of fully using a production capacity of the wells which maximize the fluid viscous forces of the above-mentioned (1).

Figures 2A, 2B, 2C:
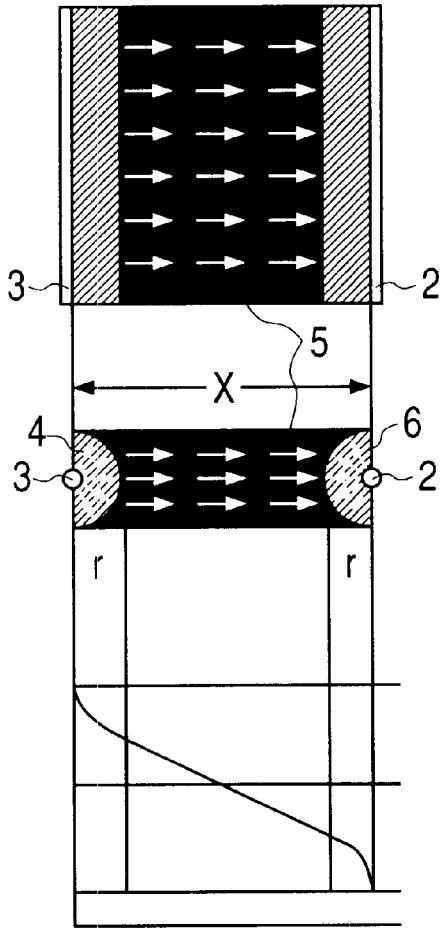
FIGS. 2(*a*) to 2(*c*) are diagrammatic views for showing flow configurations within an oil-containing reservoir and a pressure profile between the horizontal wells, and in particular, FIG. 2(*a*) shows a plan view for showing the flow configuration within the oil-containing reservoir, FIG. 2(*b*) a cross-section view for showing the flow configuration within the oil-containing reservoir, and FIG. 2(*c*) shows the pressure profile between the horizontal wells, respectively.

FIGS. 2(*a*) through 2(*c*) are diagrammatic views for showing flow configurations within an oil-containing reservoir and a pressure profile between the horizontal wells, as was also shown in the conventional art; and in particular, FIG. 2(*a*) shows a plan view for showing the flow configuration within the oil-containing reservoir, FIG. 2(*b*) a cross-section view for showing the flow configuration within the oil-containing reservoir, and FIG. 2(*c*) the pressure profile between the horizontal wells, respectively. As the condition shown in FIGS. 2(*a*) through 2(*c*), the pressure of gas injection and the pressure of oil production are fixed. A ratio between an averaged vertical permeability and an averaged horizontal permeability (hereinafter, being called by the "ratio kv/kh") is also fixed. In this case, a half- or semi-cylindrical flow 4 occurs in the vicinity of the horizontal gas injection well 3; on the other hand, a linear flow 5 appears over all the thickness of formation when it is separated far from the vicinity of the gas injection well 3. Further, in the vicinity of the horizontal production well 2, the half- or semi-cylindrical flow 6 occurs again. Further, "X" indicates the distance between the horizontal wells, and "r" a radius of the half- or semi-cylindrical flow.

By the way, the present invention applies the fact that the portion where the semi-cylindrical flow 4 occurs depends upon the ratio kv/kh and the layer thickness of the formation; and in particular when the layer thickness of the formation is fixed, the ratio kv/kh has an influence upon a pressure profile between the horizontal wells.

Figure 3A:
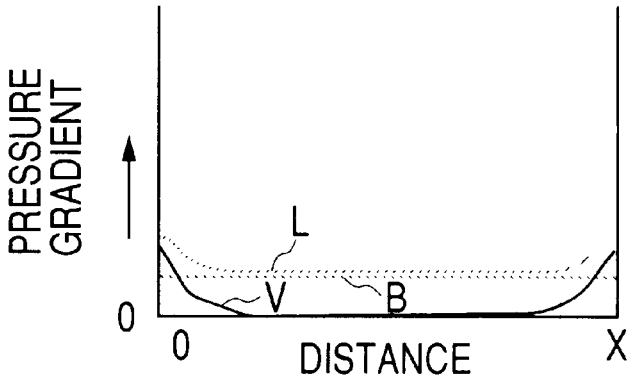
FIGS. 3(*a*) to 3(*c*) are diagrammatic views of a displacement process of crude oil with injection gas, showing the flow configurations within the oil-containing reservoir, upon the basis of the flow configurations and the pressure profile between the horizontal wells, according to the present invention.
Figure 3B:
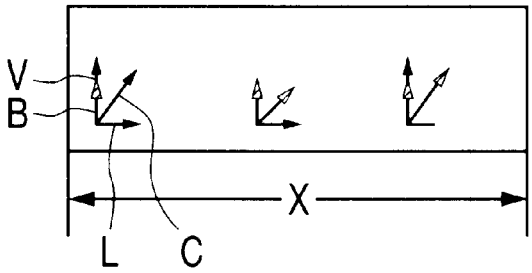
Figure 3C:
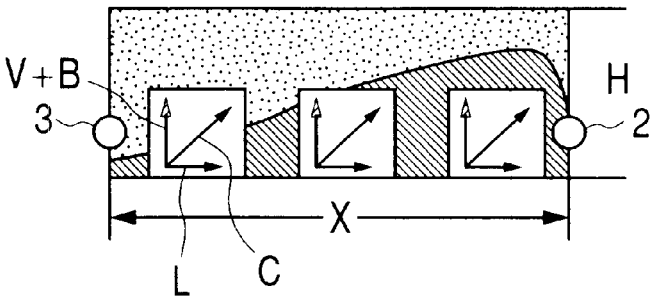

FIGS. 3(*a*) to 3(*c*) are diagrammatic views of a displacement process of crude oil with injection gas, showing the flow configurations within the oil-containing reservoir upon the basis of the flow configurations and the pressure profile between the horizontal wells, according to the present invention. FIG. 3(*a*) shows the profiles between the horizontal wells, including viscous force (pressure gradient) composed of viscous force L in the horizontal direction and the viscous force V in the vertical direction and further buoyancy B, while showing the distance on the horizontal axis and the pressure gradient on the vertical axis. FIG. 3(*b*) shows the viscous forces L and V and the buoyancy B by arrows of the respective directions thereof. Further, the mark C shows a force being composed thereof. FIG. 3(*c*) shows the condition where crude oil is swept out through the gas injection.

As apparent from those FIGS. 3(*a*) to 3(*c*), the factor controlling or governing the behavior of sweeping of the crude oil by the gas injection is a balance between the viscous forces L and V and the buoyancy B. When fixing each of the injection pressure at the horizontal gas injection well 3 and the production pressure at the horizontal production well 2, and the ratio kv/kh, respectively, it is found out that the viscous forces L and V are affected only by the distance "X" between the wells. Namely, if the viscous forces L and V are very large compared to the buoyancy B, the injection gas injected from the horizontal gas injection well 3 does not disperse up and down, but reaches to the horizontal production well 2 directly, and therefore an amount of the crude oil displaced thereby comes to be very restricted. To the contrary, if the buoyancy B is very large comparing to those viscous forces L and V, the injection gas sweeps out only a very little part of a most-upper portion of the oil-containing reservoir, and therefore that displaced thereby comes to be a very little amount.

Then, according to the present invention, an optimization can be made for the distance between the horizontal gas injection well 3 and the horizontal production well 2, by conducting a simulation, upon the basis of the factors mentioned above, of the oil-containing reservoir, from which the oil production is expected, thereby obtaining an improvement in the recovery factor of crude oil. Namely, as a model for the simulation, an area defined between the horizontal gas injection well 3 and the horizontal production well 2 shown in FIG. 1 is applied to, i.e., a vertical two (2) dimensional oil-containing reservoir model. With this model, the oil-containing reservoir having such physical property values shown in FIG. 4 (including layer thickness, porosity and horizontal permeability of the formation), defined between the horizontal gas injection well 3 and the horizontal production well 2, is divided into twenty-two (22) pieces, for example, in the direction of depth (i.e., divided in the layer thickness, so as to be as uniform in the qualities as possible, in the porosity and the horizontal permeability thereof), and by the distance of 25 m, for example, in the direction of the distance "X" between the wells. Each of those, which are divided into the grid-like ones, is called a grid, hereinafter. In particular, in the table showing the physical property values in FIG. 4, there is a certain correlation between the porosity and the horizontal permeability. However, due to the difference in the quality of rocks in each of the layers divided, in spite of the porosities in the vicinity of 12% of the layer Nos. 5, 21 and 22, the values of the horizontal permeability differs greatly from one another, for example, 0.62, 0.002 and 0.32. This means that the rocks are different from one another in the qualities thereof.

For each of the blocks which are dispersed in this manner, initial data such as the temperature to be set for the oil-containing reservoir, the pressure of the gas injected from the gas injection well 3, and the compositional ingredients of the crude oil (shown in FIG. 5) are inputted, and then the gas having the certain compositional ingredients (shown in FIG. 5) is injected with pressure from a modeled gas injection well 3 into the oil-containing reservoir having the physical property values mentioned above, thereby executing a numerical calculation on time-sequential changes of the pressure and the gradients in each of the grids divided, by using a simulator software, "Eclipse 300" (a trade name of Geoquest, Co., Ltd.) available on the market, upon the basis of the known law of conservation of mass and Darcy's law.

The law of conservation of mass can be expressed by the following equation (Eq. 1) for each ingredient "i". And, the Simulator mentioned above uses a discrete one of the (Eq. 1):

$$\sum_{r=1}^{n_p}\left\{\frac{\partial(\rho_r S_r \phi X_r^i)}{\partial t}+\nabla\cdot(\rho_r V_r X_r^i)\right\}=0 \qquad \text{(Eq. 1)}$$

where, "r" means a phase; "ρ" phase density, "S" phase saturation factor, "ϕ" porosity factor, "X" mol ratio, "V" phase velocity; and "$n_p$" a number of phases, respectively.

Also, Darcy's law is an equation of experiences, representing a relationship between velocity and viscosity of a fluid passing through a porous medium and pressure gradient, as indicated by the following equation (Eq. 2)

$$V=-(k/\mu)(dp/dx) \qquad \text{(Eq. 2)}$$

where, "v" indicates flow velocity; "k" permeability of rock; "$\mu$" viscosity of fluid; and "dp/dx" pressure gradient, respectively. Namely, the flow velocity is in inverse proportion to the viscosity while it is in proportion to the pressure gradient, and a constant of proportionality thereof is the permeability. The permeability is the value, which is inherent to the rock, and is represented by a unit of "Darcy".

Next, FIG. 4 shows the physical property values of the layer thickness, the porosity and the horizontal permeability in a certain oil-containing reservoir. Those three kinds of physical property values are allowed to have different values for each layer; however, since the optimum value of the distance between the horizontal wells lies within a range around from 500 m to 1,500 m, they are assumed to be changed very little in the horizontal direction, and further assumed to have no change within the same layer. Accordingly, in a case where those three kinds of physical property values change greatly within the range around from 500 m to 1,500 m of the optimum value between the horizontal wells, it may be sufficient to input the physical property values, which are changed for each distance of 40 m, for example, into which the oil-containing reservoir is divided.

Figures 5, 6:
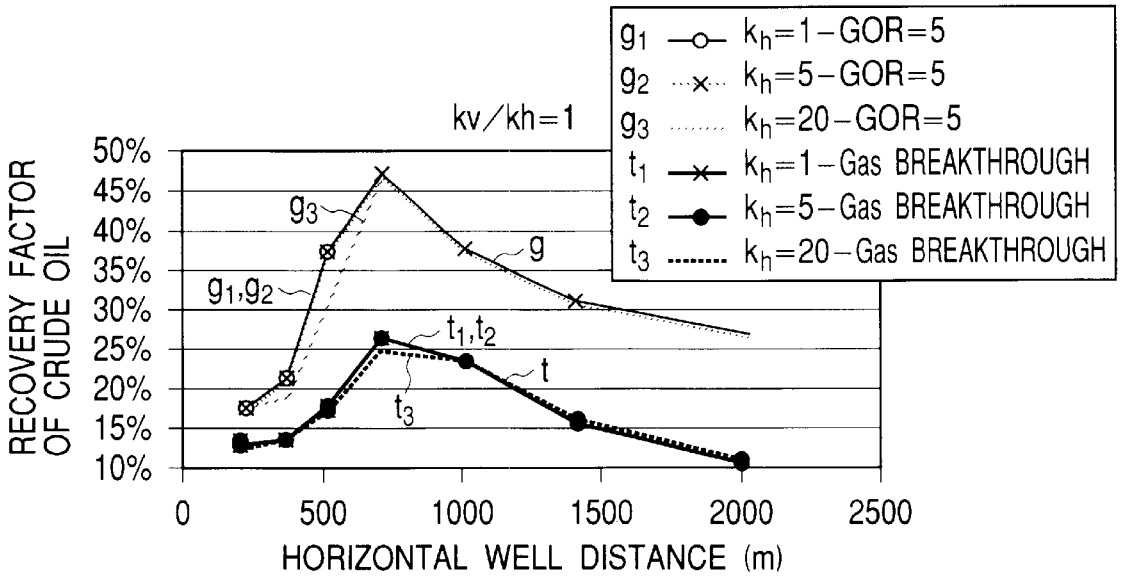
FIG. 5 shows an example of compositional ingredients of crude oil in a certain oil-containing reservoir, and compositional ingredients of a gas to be injected from gas injection wells.
FIG. 6 is a graph for showing recovery factors of crude oil, being obtained through simulations by changing permeability in the horizontal direction within the oil-containing reservoir into three (3) kinds thereof, as well as the distance between the horizontal wells.

Also, FIG. 5 shows the compositional ingredients of the crude oil which is originated from the same oil-containing reservoir as was mentioned above, as well as of the injection gas. In the present embodiment, the crude oil is only one kind thereof, as shown in FIG. 5. The pressure gas to be injected from the horizontal gas injection well 3 is also supposed to have the compositional ingredients as shown in FIG. 5. The crude oil contains 0.655 of the ingredients of intermediate qualities being higher than C6; to the contrary, the injection gas is 0.737 methane. Also, as sensitivity, also a case of injecting 100% methane gas with pressure is calculated out. Compared to the 100% methane gas, the injection gas contains 0.155 and 0.063 of C2 and C3, respectively, and has a property of easily dissolving into crude oil.

As was explained above, by conducting a simulation of a relationship of the recovery factors where the injection gas containing the ingredients shown in FIG. 5 is injected from the horizontal gas injection well 3 into the oil-containing reservoir (of layer thickness of about 50 m), which has the physical property values shown in FIG. 4 and is pregnant with the crude oil containing the ingredients shown in FIG. 5, while changing the distance between the horizontal wells, results as shown in FIGS. 6, 7, 8, 9, 10, 11 and 12 are obtained.

Namely, FIG. 6 shows the recovery factors of crude oil (a cumulative amount of production/deposits) in the case where the horizontal well distance between the horizontal gas injection well 3 and the horizontal production well 2 is changed within a range from 200 m to 2 km and the averaged horizontal permeability kh to 1 mD, 5 mD and 20 mD, respectively, as shown at upper-right therein. The case t (from t1 to t3) shows the recovery factor of crude oil when the injection gas reaches the production well 2 (when it breaks through (B'thru)), and the case g (from g1 to g3) shows the recovery factor when the gas-oil ratio (GOR) reaches 5,000 scf/stb (5 Mscf/stb). Herein, the averaged value kh of the horizontal permeability of the oil-containing reservoir is assumed to be of three (3) kinds, i.e., 1 mD, 5 mD and 20 mD. Then, in all of the cases, common values are given to the production pressure and the injection pressure. Also, the ratio (the ratio "kv/kh") between the averaged vertical permeability "kv" and the averaged horizontal permeability "kh" is assumed to be one (1). As apparent from t1–t3 and g1–g3 in FIG. 6, it can be seen that there exists the horizontal well distance, which can give the maximum recovery factor of crude oil according to the present invention. And, it also can be seen that the averaged horizontal permeability "kh" hardly exerts an influence upon the recovery factor of crude oil if the value "kv/kh" is at a constant value (being constant in the pressure gradient).

Figure 7:
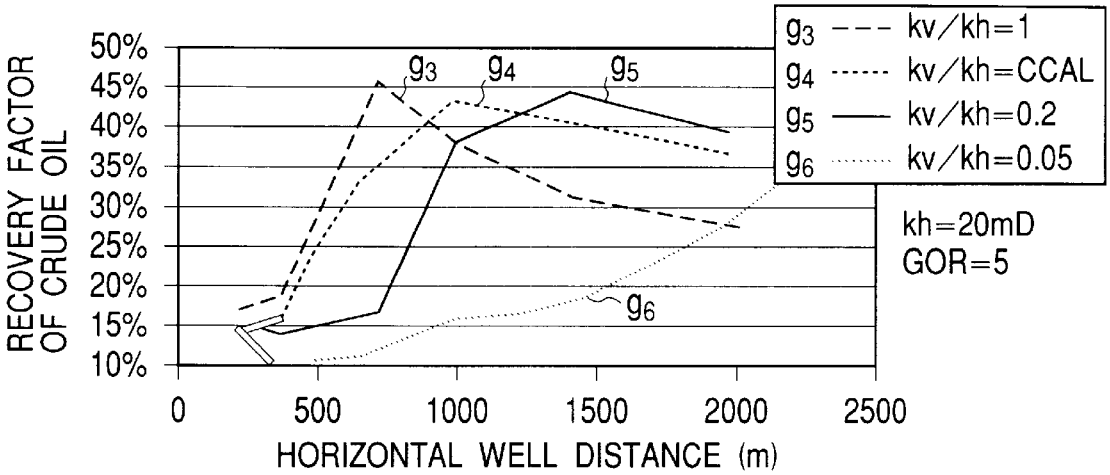
FIG. 7 is a graph for showing recovery factors of crude oil, being obtained through simulations by changing a ratio between an averaged vertical permeability and an averaged horizontal permeability (hereinafter, being called by the "ratio kv/kh") of the oil-containing reservoir into four (4) kinds thereof, as well as the distance between the horizontal wells.

Also, FIG. 7 shows the recovery factors of crude oil (the cumulative amount of production/deposits), in the case where the horizontal well distance between the horizontal gas injection well 3 and the horizontal production well 2 is changed within the range from 200 m to 2 km, and the ratio between the averaged vertical permeability and the averaged horizontal permeability is changed, as shown at upper-right therein, and in particular when the gas-oil ratio (GOR) reaches 5 Mscf/stb. Herein, there are assumed four (4) kind of cases, including g3, g5 and g6, where the averaged value "kh" of the horizontal permeability is fixed at 20 mD in the oil-containing reservoir mentioned above and the ratio (the ratio "kv/kh") between the averaged vertical permeability "kv" and the averaged horizontal permeability "kh" is given by 1, 0.2 and 0.05, uniformly, and G4 in a case of CCAL (Conventional Core Analysis) having unevenness or fluctuation therein, which can be obtained by referring to the actual samples of the oil-containing reservoirs. Also, common values are given to the production pressures and the injection pressures. As apparent from g3 to g6 in FIG. 7, although there exists the horizontal well distance, according to the present invention, which can give the maximum recovery factor of crude oil, it is clear that such optimal horizontal well distance changes depending upon the ratio "kv/kh". With this, as was shown in FIG. 2, it is proved that the pressure profile of the horizontal well distance is affected by the ratio "kv/kh".

As a result of this, for achieving optimization of the horizontal well distance according to the present invention, it is necessary to presume or speculate the ratio "kv/kh" in the oil-containing reservoir to be drilled for the horizontal wells, from the core analysis and the spot test. And, treating the simulation, upon the basis of the ratio "kv/kh" presumed, enables to calculate an optimal horizontal well distance according to the present invention. Also, when the ratio "kv/kh" comes to be small, such as about 0.2 rather than 1, the optimal horizontal well distance is widened from about 700 m to about 1.5 km. Further, when the ratio "kv/kh" comes to be less than 0.2, the averaged horizontal permeability comes to be small, and then the injection gas reaches directly or straight forward to the horizontal production well 2 without dispersing up and down even if the horizontal well distance is widened up to about 2 km, and therefore the crude oil to be displaced therewith is limited, such as about 30% in the recovery factor of crude oil.

As was explained above, the optimal horizontal well distance according to the present invention is greatly affected by the ratio between the averaged vertical permeability and the averaged horizontal permeability in the oil-containing reservoir.

Figure 8:
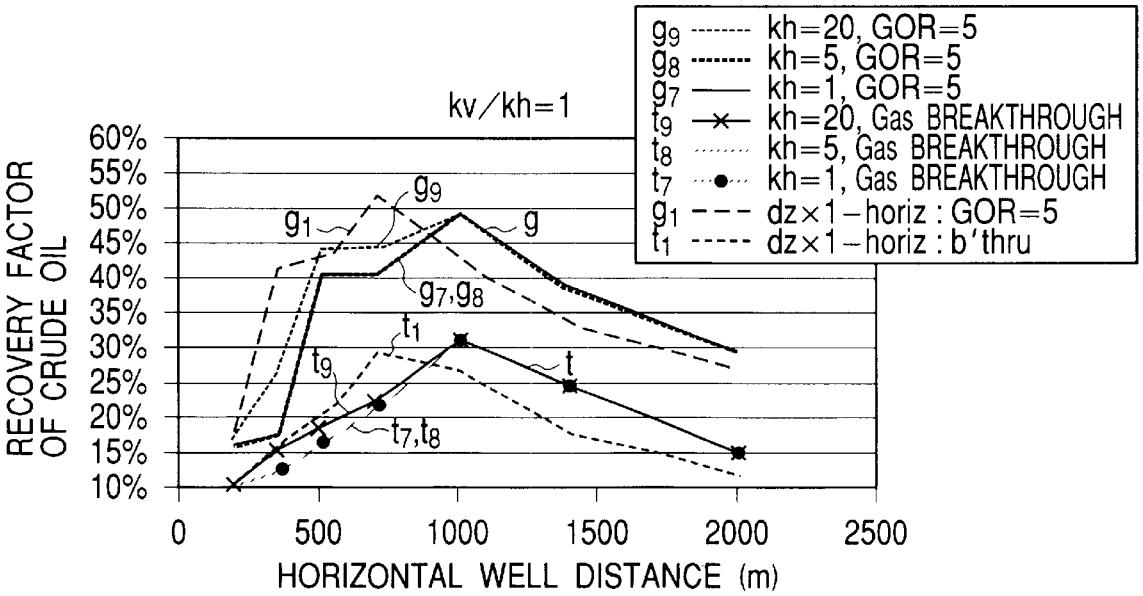
FIG. 8 is a graph for showing the recovery factors of crude oil, being obtained through simulations by changing permeability in the horizontal direction within the oil-containing reservoir into three (3) kinds thereof, as well as the distance between the horizontal wells, but setting the oil-containing reservoir model to be two (2) times as large in thickness as that treated in FIGS. 6 and 7 mentioned above.

Next, explanation will be given on a relationship between the layer thickness of the oil-containing reservoir and the horizontal well distance according to the present invention, by referring to FIGS. 8 and 9. FIG. 8 shows a result of the simulation made in the similar manner, but by setting the oil-containing reservoir model at the layer thickness (about 100 m) two (2) times as large as that treated in the above-mentioned FIGS. 6 and 7. The case of t7–t9 indicates the recovery factor when the injection gas reaches to the production well 2 (the B'thru), and the case of g7–g9 when the gas-oil ratio (GOR) reaches to 5,000 scf/stb (5 Mscf/stb). Herein, the averaged value "kh" of horizontal permeability of the oil-containing reservoir is assumed to be in three (3) kinds, i.e., 1 mD, 5 mD and 20 mD. And then, in all of the cases, common values are given to the production pressure and the injection pressure. Also, the ratio between the averaged vertical permeability and the averaged horizontal permeability (the ratio "kv/kh") is assumed to be 1. As apparent from t7–t9 and g7–g9 in FIG. 8, it is found out that there can exist the horizontal well distance which gives the maximum recovery factor of crude oil according to the present invention, even when the layer thickness comes to be two (2) times as large as the oil-containing reservoir. However, it also becomes clear that the optimal horizontal well distance is widened up to about 1 km when the oil-containing reservoir is two (2) times as large in the layer thickness thereof. Namely, it can be seen, in the case where the ratio "kv/kh" of the oil-containing reservoir is 1 and the layer thickness thereof is about 100 m, preferably the horizontal well distance is set around from 700 m to 1,200 m.

Figure 9:
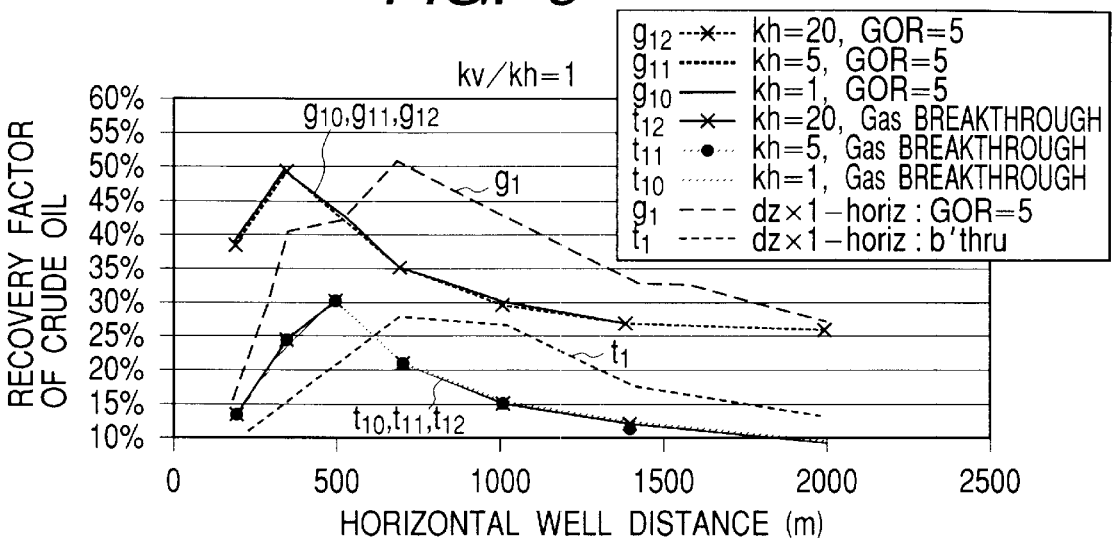
FIG. 9 is a graph for showing the recovery factors of crude oil, being obtained through simulations by changing permeability in the horizontal direction within the oil-containing reservoir into three (3) kinds thereof, as well as the distance between the horizontal wells, but setting the oil-containing reservoir model to be one-fifth (⅕) the thickness of that treated in FIGS. 6 and 7 mentioned above.

Also, FIG. 9 shows a result of the simulation made in the similar manner, but with setting the oil-containing reservoir model at the layer thickness of about 10 m, i.e., one-fifth (1/5) of that treated in the above-mentioned FIGS. 6 and 7. The case t10–t12 indicates the recovery factor when the injection gas reaches to the production well 2 (the B'thru), and the case g10–g12 when the gas-oil ratio (GOR) reaches to 5,000 scf/stb (5 Mscf/stb). Herein, the averaged value "kh" of horizontal permeability of the oil-containing reservoir is also assumed to be in three (3) kinds, i.e., 1 mD, 5 mD and 20 mD. And then, in all of the cases, common values are given to the production pressure and the injection pressure. Also, the ratio between the averaged vertical permeability and the averaged horizontal permeability (the ratio "kv/kh") is assumed to be 1. As apparent from t10–t12 and g10–g12 in FIG. 9, it is also found out that there can exist a horizontal well distance which gives the maximum recovery factor of crude oil according to the present invention, even when the layer thickness comes to be one-fifth (1/5) of the oil-containing reservoir. However, it also becomes clear that the optimal horizontal well distance comes to be narrow to about 300 m when the oil-containing reservoir comes to be one-fifth (1/5) the layer thickness thereof. Namely, it can be seen, in the case where the ratio kv/kh of the oil-containing reservoir is 1 and the layer thickness thereof is about 10 m, preferably, the horizontal well distance is set around from 200 m to 600 m.

From FIGS. 8 and 9 mentioned above, it is possible to ascertain that the optimal horizontal well distance exists if the ratio "kv/kh" is constant, even when the oil-containing reservoir to be drilled changes in the layer thickness thereof. It also becomes clear that the averaged horizontal permeability "kh" has an influence not so much upon the recovery factor of crude oil, if the ratio "kv/kh" is constant.

Figure 10:
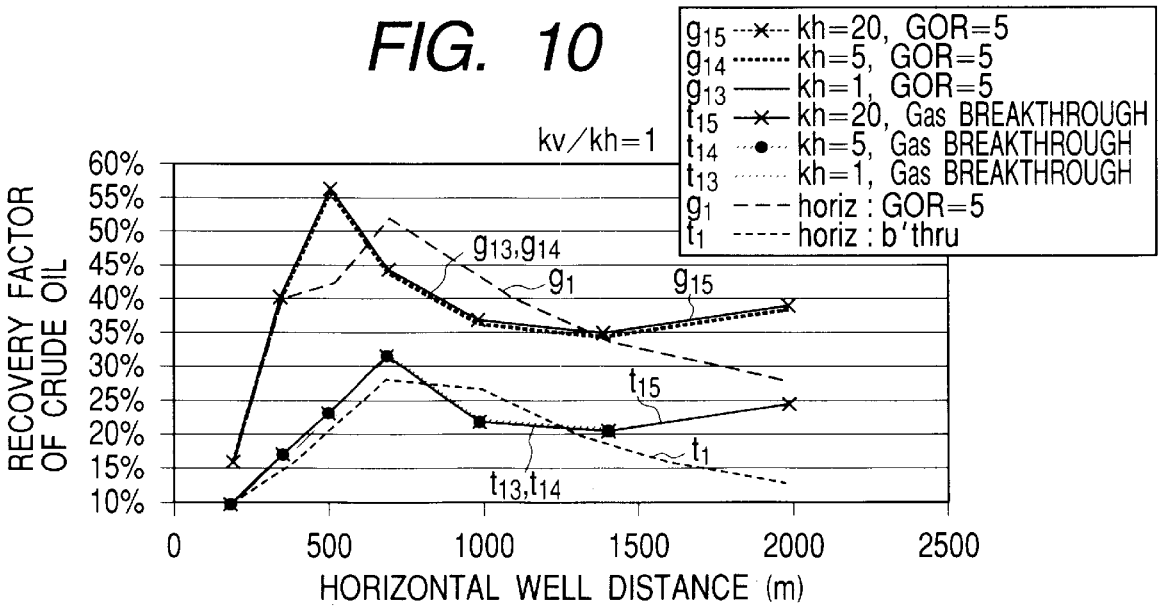
FIG. 10 is a graph for showing the recovery factors of crude oil, being obtained through simulations by changing permeability in the horizontal direction within the oil-containing reservoir into three (3) kinds thereof, as well as the distance between the horizontal wells, while inclining the oil-containing reservoir model treated in FIGS. 6 and 7 mentioned above by sixty (60) degrees from the horizontal plane, locating the gas injection wells upward and the production wells downward.

Next, explanation will be given on a relationship between an inclination of the oil-containing reservoir and the horizontal well distance according to the present invention, by referring to FIGS. 10, 11 and 12. FIG. 10 shows a result of the above-mentioned simulation, wherein the model of oil-containing reservoir, which is treated in the above-mentioned FIGS. 6 and 7, is inclined by sixty (60) degrees from the horizontal plane with positioning the gas injection well 3 upward and the production well 2 downward, i.e., the recovery factors of crude oil at the times t13–t15 of breakthrough (B'thru) for each horizontal well distance and those at the times g13–g15 when the gas-oil ratio reaches 5 Mscf/stb, respectively. Herein, the averaged value "kh" of horizontal permeability of the oil-containing reservoir is also assumed to be in three (3) kinds, i.e., 1 mD, 5 mD and 20 mD. However, t1 and g1 show the cases where the horizontal wells are not inclined. As apparent from t13–t15 and g13–g15 in FIG. 10, it can be seen that the influences of the averaged horizontal permeability upon the optimal horizontal well distance and the recovery factor of crude oil are small, even in the case where the oil-containing reservoir is inclined by sixty (60) degrees with positioning the gas injection well 3 upward and the production well 2 downward.

Figure 11:
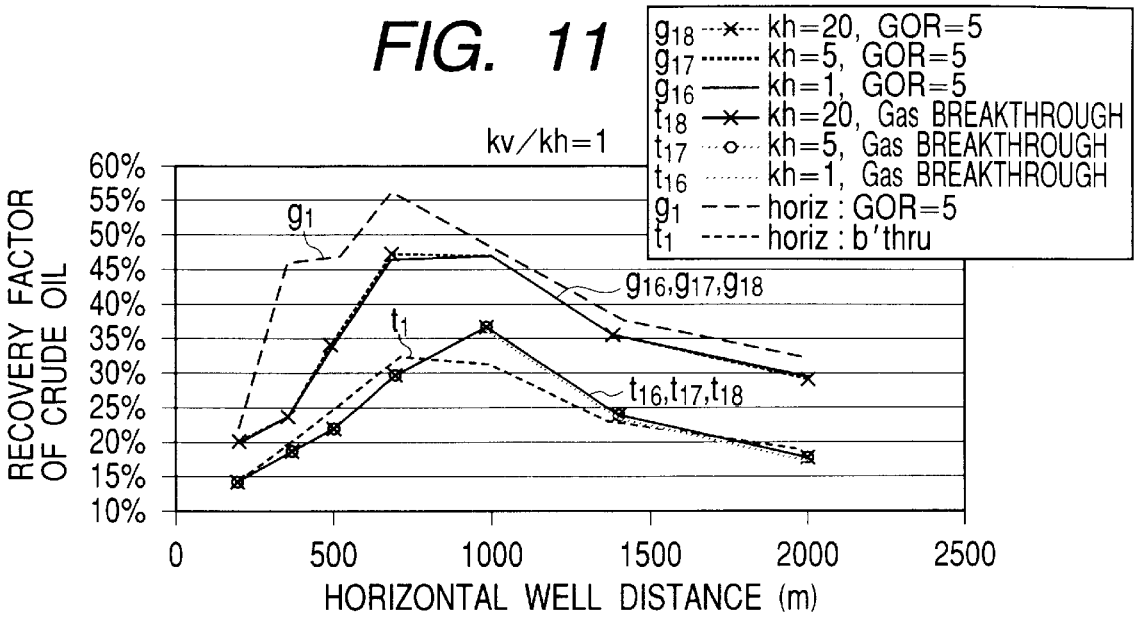
FIG. 11 is a graph for showing the recovery factors of crude oil, being obtained through simulations by changing permeability in the horizontal direction within the oil-containing reservoir into three (3) kinds thereof, as well as the distance between the horizontal wells, while inclining the oil-containing reservoir model treated in FIGS. 6 and 7 mentioned above by sixty (60) degrees from the horizontal plane, but locating the gas injection wells downward and the production wells upward.

Also, FIG. 11 shows a result of the simulation made with inclining the oil-containing reservoir by sixty (60) degrees and setting the position of the wells upside down, i.e., positioning the production well upward and the gas injection well downward, and it includes the respective recovery factors of crude oil at each horizontal well distance, at the times t16–t18 of break-through and at the times g16–g18 when the gas-oil ratio reaches 5 Mscf/stb. Herein, also the averaged value "kh" of the horizontal permeability of the oil-containing reservoir is assumed to be in three (3) kinds, i.e., 1 mD, 5 mD and 20 mD. However, t1 and g1 show the cases where the horizontal wells are not inclined. From FIG. 11, it becomes clear that there exists a well distance. which brings the recovery factor of crude oil at the maximum even if the production well 2 and the gas injection well 3 are reversed in positional relationship between them. Also in this case, it can be seen that the influences of the horizontal permeability upon the optimal horizontal well distance and the recovery factor of crude oil are small.

Figure 12:
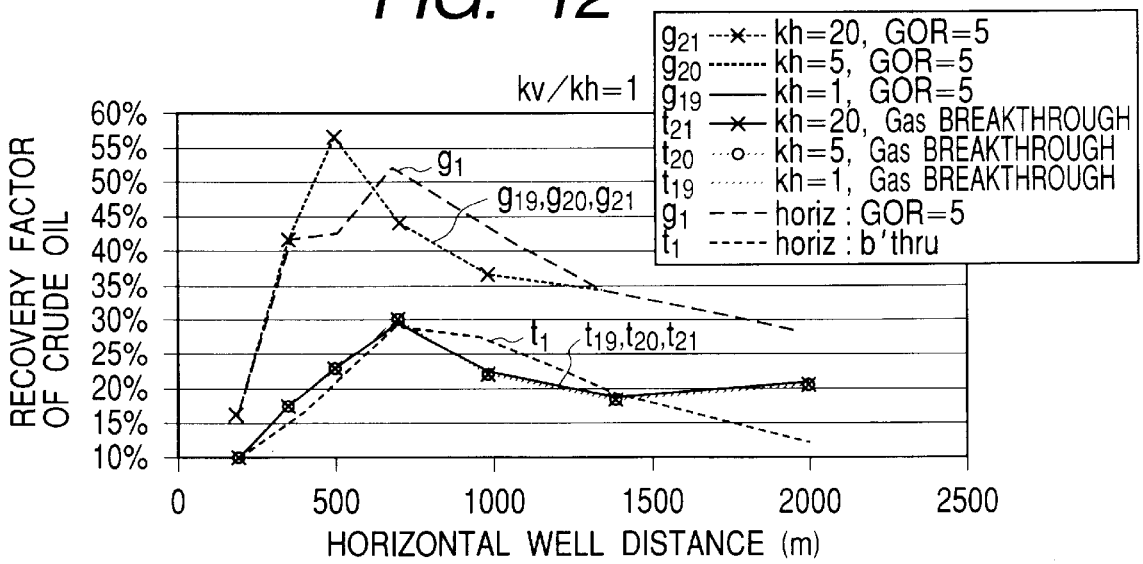
FIG. 12 is a graph for showing the recovery factors of crude oil, being obtained through simulations by changing permeability in the horizontal direction within the oil-containing reservoir into three (3) kinds thereof, as well as the distance between the horizontal wells, while inclining the oil-containing reservoir model treated in FIGS. 6 and 7 mentioned above by forty-five (45) degrees from the horizontal plane, locating the gas injection wells upward and the production wells downward.

Also, FIG. 12 shows a result of the simulation in a case where the inclination of the oil-containing reservoir is inclined by 45 degrees from the horizontal plane, compared to 60 degrees in the above-mentioned FIG. 11, and it is indicated by t19–t21 and g19–g21. Herein, also the averaged value "kh" of the horizontal permeability of the oil-containing reservoir is assumed to be in three (3) kinds, i.e., 1 mD, 5 mD and 20 mD. Moreover, t1 and g1 show the cases where the horizontal wells are not inclined. From FIG. 12, it can be seen that the influences of the horizontal permeability upon the optimal horizontal well distance and the recovery factor of crude oil are small.

From the above FIGS. 10 through 12, it can be found out that, if the oil-containing reservoir to be drilled is inclined, there exists the optimal horizontal well distance bringing the recovery factor at the maximum, by positioning the horizontal gas injection well 3 and the horizontal production well 2 an inclination thereof.

Figure 13:
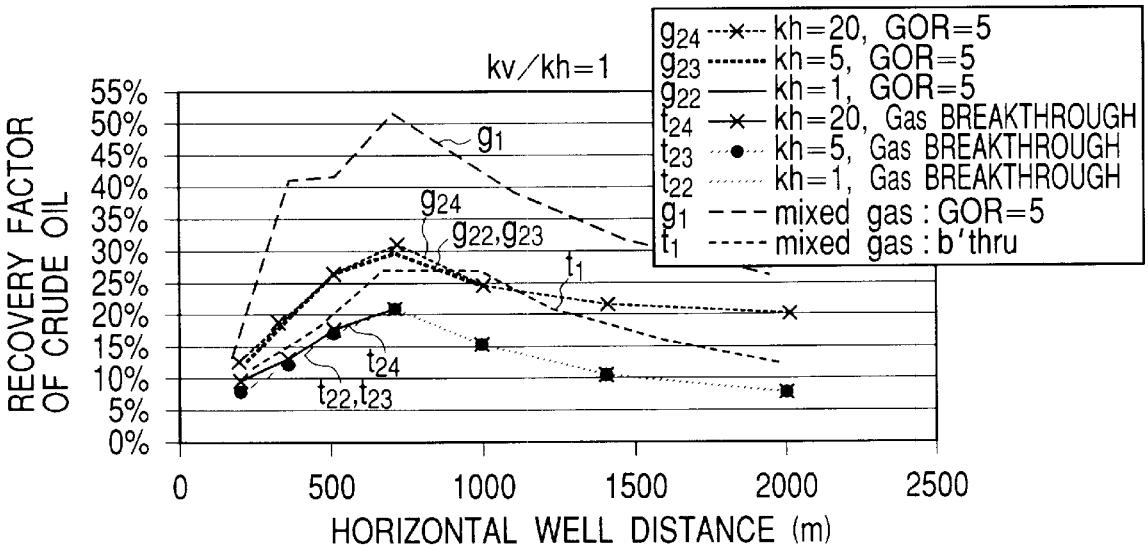
FIG. 13 is a graph for showing the recovery factors of crude oil, being obtained through simulations by changing permeability in the horizontal direction within the oil-containing reservoir into three (3) kinds thereof, as well as the distance between the horizontal wells, but in a case where a 100% methane gas is injected with pressure.

Next, explanation will be given for an embodiment of the optimal horizontal well distance according to the present invention, in particular when changing the ingredients of the injection gas, by referring to FIG. 13. FIG. 13 shows a result when a 100% methane gas is injected into the models of oil-containing reservoirs, which are treated in the above-mentioned FIGS. 6 and 7, and is indicated by t22–t24 and g22–g24. From this, it becomes clear that there exists a well distance which can bring the recovery factor of crude oil at the maximum even if the injection gas is changed in the composition of gradients thereof. In particular, as apparent from FIG. 13, when the injection gas is changed in the composition of gradients thereof, the buoyancy caused due to the difference between the crude oil and the injection gas is changed, and as a result of this, the recovery factor of the crude oil is changed.

As was fully described in the above, according to the present invention it is possible to obtain an optimization of the horizontal well distance by paying attention to the ratio between the averaged vertical permeability and the averaged horizontal permeability in the oil-containing reservoir to be drilled through the horizontal wells. For that purpose, according to the present invention, it is necessary to investigate and calculate the ratio of averaged vertical permeability/averaged horizontal permeability, the layer thickness and the inclination of the oil-containing reservoir, by conducting a core analysis and/or a spot test (including the special well test) on the oil-containing reservoir to be drilled through the horizontal wells. In particular, the layer thickness and/or the inclination of the oil-containing reservoir can be investigated easily. Also, the ratio of averaged vertical permeability/averaged horizontal permeability (the ratio of "kv/kh") can be also assumed easily.

By the way, when the horizontal wells are actually drilled into the oil-containing reservoir, in particular when a planning proceeds so that, after drilling one of the gas injection well 3 and the production well 2, another one of the remaining wells is determined at the optimal well distance upon the basis of the physical property values obtained from that oil-containing reservoir, it is possible to assume the ratio of averaged vertical permeability/averaged horizontal permeability (the ratio of "kv/kh") in that oil-containing reservoir, through the core analysis when the one of the wells is drilled.

Also, under the condition that the drilling position should be determined before drilling both the gas injection well 3 and the production well 2, it is necessary to use data, which are obtained from neighboring drilled wells within the same oil-containing reservoir, or alternatively to use other data obtained from analogous oil-containing reservoirs.

Then, if it is possible to obtain the data of wells, the averaged vertical permeability and the averaged horizontal permeability can be calculated through a data obtaining method which will be explained below.

(1) The data of permeability are obtained for each direction, through a test using rock samples of the oil-containing reservoir, which can be conducted in a room. Namely, the permeability is calculated based upon data measured on flow-rate and/or pressure, while flowing a fluid into that sample.

(2) The permeability is calculated for each direction by conducting a spot test in the very vicinity of the well, by means of a layer detector apparatus located within the well.

In particular, according to the present invention, it has been found out that the ratio of averaged vertical permeability/averaged horizontal permeability (the ratio of "kv/kh") is most important for determining the optimal horizontal well distance, among various factors thereof.

Accordingly, upon the basis of that ratio of averaged vertical permeability/averaged horizontal permeability (the ratio of "kv/kh"), the layer thickness and the inclination of the oil-containing reservoir, it is possible to calculate the optimal horizontal well distance. And, drilling the horizontal gas injection well 3, as well as drilling the horizontal production well 2, so that they are located or separated at the calculated optimal horizontal well distance between them, enables the oil production at the maximum recovery factor of crude oil from that oil-containing reservoir.

INDUSTRIAL APPLICABILITY

According to the present invention, it is easily possible to produce the oil from an oil-containing reservoir with good efficiency, by optimizing the distance, etc., between the gas injection well and the production well of the horizontal wells to be drilled into the oil-containing reservoir.

What is claimed is:

1. A method for producing oil from an oil-containing reservoir, comprising a sequence of the following steps:

a first calculation step for calculating a ratio between an averaged vertical permeability and an averaged horizontal permeability, a layer thickness and an inclination, based upon a result of a core analysis or a spot test on the oil-containing reservoir producing the oil therefrom;

a second calculation step for calculating an appropriate distance between a gas injection well and a production well, through conducting simulation upon a relationship between viscous force and buoyancy using a model of horizontal wells on said oil-containing reservoir, from the averaged vertical permeability and the averaged horizontal permeability, the layer thickness and the inclination, which are provided in said first calculation step;

a step of drilling the horizontal wells including the gas injection well and the production well, so that they are kept at the calculated appropriate distance between them, which is calculated in said second calculation step; and a step for producing the oil from the oil-containing reservoir using the horizontal wells drilled in said drilling step.

2. A method for producing oil as defined in claim 1, wherein said producing step includes a step of injecting at least one of methane gas and a gas containing $CO_2$.

3. A method for determining an optimum distance between a horizontal producing well and a horizontal gas injection well, comprising the steps of:

preparing at least a ratio between an averaged vertical permeability and an averaged horizontal permeability of an oil-containing reservoir;

calculating an appropriate distance based upon the ratio between the averaged vertical permeability and the averaged horizontal permeability of the oil-containing reservoir; and determining the appropriate distance calculated in said calculating step to be the optimum distance between the horizontal producing well and the horizontal gas injection well.

4. A method for determining an optimum distance as defined in claim 3, wherein said ratio between the averaged vertical permeability and the averaged horizontal permeability is calculated based upon a result of a core analysis or a spot test in the oil-containing reservoir.

5. A method for producing oil from an oil-containing reservoir, using horizontal wells, which are drilled into the oil-containing reservoir at the distance calculated in the method defined in claim 4.

6. A method for producing oil as defined in claim 5, further including a step of injecting at least one of methane gas and a gas containing $CO_2$ into said horizontal wells.

7. A method for producing oil from an oil-containing reservoir using horizontal wells, which are drilled into the oil-containing reservoir at the distance calculated in the method defined in claim 3.

8. A method for producing oil as defined in claim 7. further including a step of injecting at least one of methane gas and a gas containing $CO_2$ into said horizontal wells.

9. A method for determining an optimum distance between a horizontal producing well and a horizontal gas injection well, comprising the steps of:

preparing a ratio between an averaged vertical permeability and an averaged horizontal permeability, a layer thickness, an inclination of an oil-containing reservoir and composition of a gas to be injected;

calculating an appropriate distance based upon the ratio between the averaged vertical permeability and the averaged horizontal permeability of the oil-containing reservoir, prepared in said preparing step; and determining the appropriate distance calculated in the calculating step to be the optimum distance between the horizontal producing well and the horizontal gas injection well.

10. A method for determining an optimum distance as defined in claim 9, wherein said ratio between the averaged vertical permeability and the averaged horizontal permeability is calculated based upon a result of a core analysis or a spot test in the oil-containing reservoir.

11. A method for producing oil from an oil-containing reservoir, using horizontal wells, which are drilled into the oil-containing reservoir at the distance calculated in the method defined in claim 10.

12. A method for producing oil as defined in claim 11, further including a step of injecting at least one of methane gas and a gas containing $CO_2$ into said horizontal wells.

13. A method for producing oil from an oil-containing reservoir, using horizontal wells, which are drilled into the oil-containing reservoir at the distance calculated in the method defined in claim 9.

14. A method for producing oil as defined in claim 13, further including a step of injecting at least one of methane gas and a gas containing $CO_2$ into said horizontal well.

* * * * *